US006233415B1

(12) United States Patent
Pang

(10) Patent No.: US 6,233,415 B1
(45) Date of Patent: May 15, 2001

(54) BELT CARTRIDGE IN A PRINTING APPARATUS

(75) Inventor: Jeong-hun Pang, Suwon (KR)

(73) Assignee: Samsung Elctronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/449,498

(22) Filed: Nov. 29, 1999

(30) Foreign Application Priority Data

Dec. 28, 1998 (KR) ..... 98-59402

(51) Int. Cl.[7] ..... G03G 15/00
(52) U.S. Cl. ..... 399/116; 399/165
(58) Field of Search ..... 399/116, 162, 399/165

(56) References Cited

U.S. PATENT DOCUMENTS 4,626,095 * 12/1986 Berger ..... 399/165
5,019,864 * 5/1991 Blanding ..... 399/165
5,122,836 * 6/1992 Fujiwara et al. ..... 399/116
5,400,121 * 3/1995 Foote ..... 399/116
5,708,924 * 1/1998 Shogren et al. ..... 399/116
6,014,535 * 1/2000 Zenk et al. ..... 399/116
6,049,682 * 4/2000 Goetzke et al. ..... 399/116

FOREIGN PATENT DOCUMENTS 4-147274 5/1992 (JP) .

* cited by examiner

*Primary Examiner*—William J. Royer
(74) *Attorney, Agent, or Firm*—Sughrue, Mion, Zinn, Macpeak & Seas, PLLC

(57) ABSTRACT

A belt cartridge in a printing apparatus, including a base board attachable to or detachable from the belt unit to be operative to face the belt unit at one surface, a support unit movably installed on the base board to be operative to selectively contact the inner surface of the photoreceptor belt, and a moving mechanism which moves the support unit toward the base board and isolates the support unit from the base board.

7 Claims, 4 Drawing Sheets

BELT CARTRIDGE IN A PRINTING APPARATUS

BACKGROUND OF THE INVENTION

1. Field of the Invention

The present invention relates to a belt cartridge in a printing apparatus for mounting a photoreceptor belt on a belt unit in a printer and withdrawing worn-out photoreceptor belts.

2. Description of the Related Art

As shown in FIG. 1, a printing apparatus such as a printer or a photocopier includes a photoreceptor belt 10 and a developing unit 20. The photoreceptor belt 10 is supported by a plurality of rollers 11, 12 and 13 installed within the main body of the printing apparatus and circulates along an endless track. The developing unit 20 develops electrostatic latent images formed on the surface of the photoreceptor belt 10.

The photoreceptor belt 10 ages over an extended period of use, so the aged photoreceptor belt should be replaced with a new photoreceptor belt to maintain the precision of an image.

In a conventional method of replacing the photoreceptor belt 10, a movably-installed roller 13, among the plurality of rollers 11, 12 and 13, is moved to a position shown by the dotted line to release the tension of the photoreceptor belt 10, the photoreceptor belt 10 is extracted from the printing apparatus, a new photoreceptor belt is inserted directly by hand, and the roller 13 is then moved back to the original position and the tension is again applied to the new photoreceptor belt.

The photoreceptor belt 10 is flexible, so replacement thereof is very complicated and difficult. Besides, the photoreceptor belt 10 may be mismounted in the printing apparatus due to the unskillfulness of a worker.

SUMMARY OF THE INVENTION

To solve the above problems, it is an object of the present invention to provide a belt cartridge for a printer which is mounted on a belt unit by supporting a photoreceptor belt to be mounted on the belt unit, and can be detached from the belt unit after collecting the photoreceptor belt when it is required to be replaced.

Accordingly, to achieve the above object of the present invention, the present invention provides a belt cartridge in a printing apparatus in which a photoreceptor belt to be mounted on a belt unit is received, the belt cartridge including: a base board attachable to or detachable from the belt unit to be operative to face the belt unit at one surface; a support unit movably installed on the base board to be operative to selectively contact an inner surface of the photoreceptor belt; and a means for moving the support unit toward the base board and for isolating the support unit from the base board.

In this case, it is preferable that the support unit includes: a pair of first support units selectively contacting the inner surface of the photoreceptor belt while approaching each other or being separated from each other in an up and down direction with the base board located therebetween; and a pair of second support units selectively contacting the inner surface of the photoreceptor belt while approaching each other or being separated from each other from side to side and having the base board located therebetween.

Also, preferably, each of the first support units includes: a plurality of first support bars which selectively contact the inner surface of the photoreceptor belt and are spaced a predetermined distance apart from each other to avoid interference with the belt unit; and first brackets which support one end of each of the first support bars and are movably installed on the base board.

It is preferable that each of the second support units includes; a plurality of second support bars which selectively contact the inner surface of the photoreceptor belt and are spaced a predetermined distance apart from each other to avoid interference with the belt unit; and second brackets which support one end of each of the second support bars and are slidably installed on the base board.

Preferably, the moving means includes: a cam rotatably installed on the base board and operative to contact the pair of first support units; connection members each hinged at one end to a corresponding one of the second support units and hinged at the other end to the cam; and elastic members for elastically biasing the pair of first support units toward the cam.

BRIEF DESCRIPTION OF THE DRAWINGS

The above object and advantages of the present invention will become more apparent by describing in detail a preferred embodiment thereof with reference to the accompanying drawings, in which.

DETAILED DESCRIPTION OF THE PREFERRED EMBODIMENT

Figure 1:
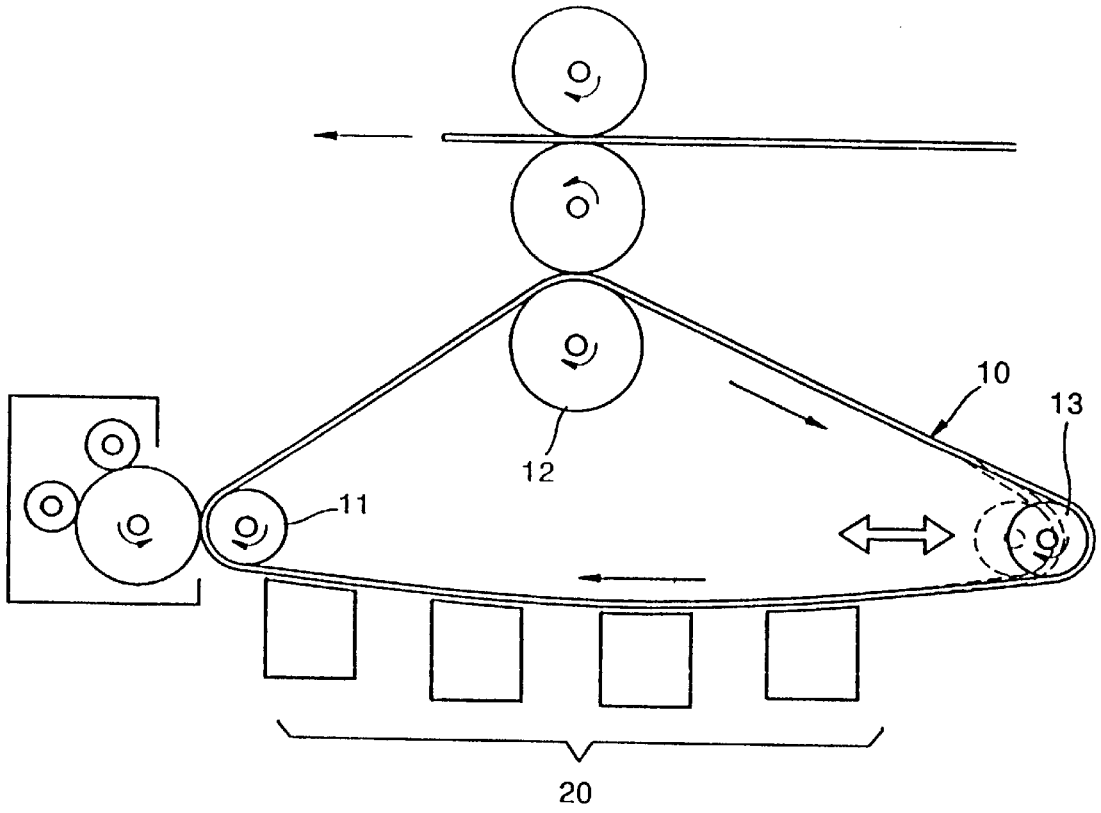
FIG. 1 PRIOR ART
FIG. 1 is a schematic configuration view of a general printing apparatus.
Figure 2:
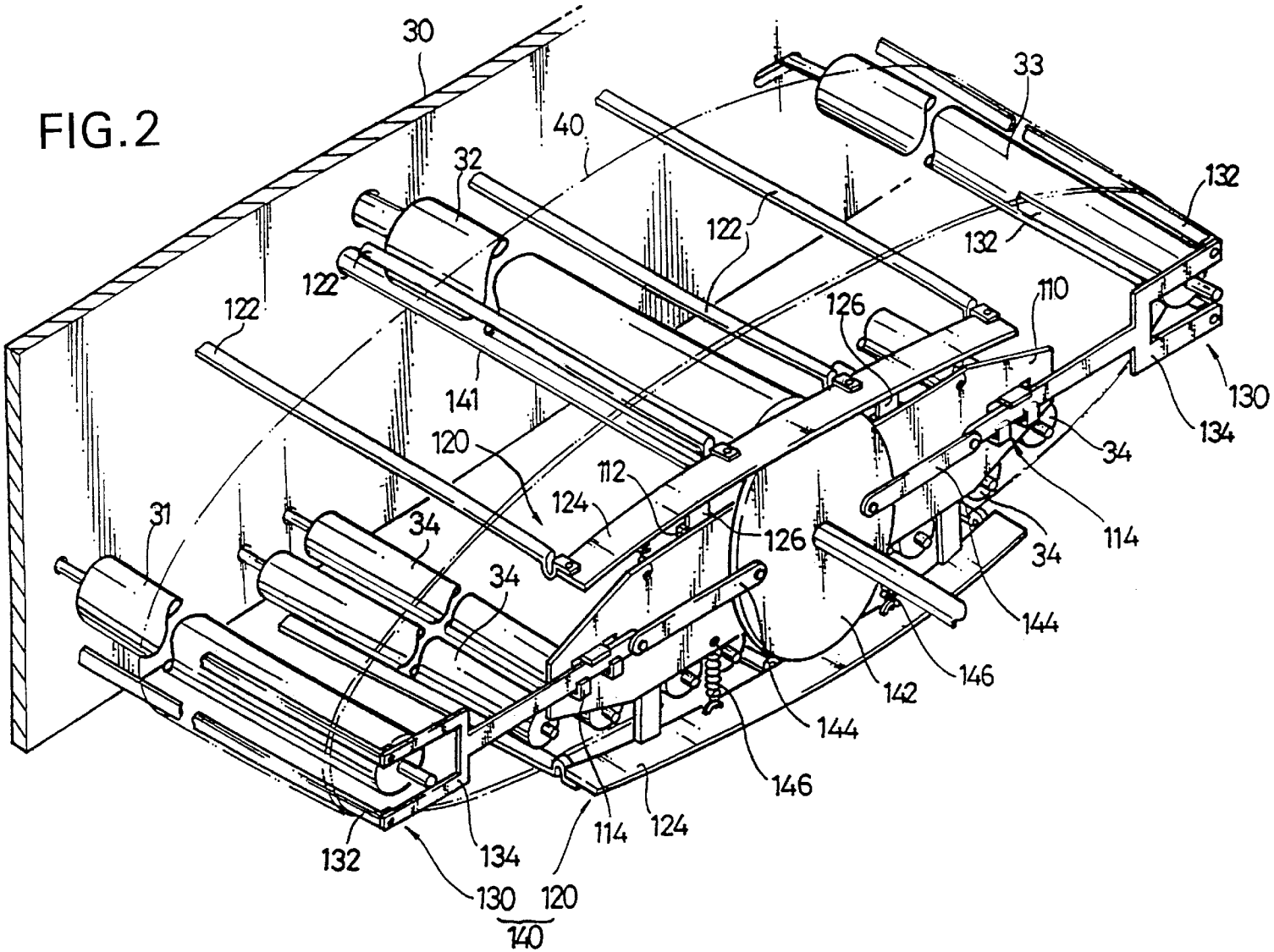
FIG. 2 is a schematic perspective view of a belt cartridge in a printing apparatus according to a preferred embodiment of the present invention.

Referring to FIG. 2, a belt cartridge in a printing apparatus according to a preferred embodiment of the present invention includes a base board 110, a support unit 140, and a moving means. The base board 110 can be attached to and detached from a belt unit to be capable of facing the belt unit having a plurality of support rollers 31, 32 and 33 and backup rollers 34 installed on a frame 30. The ends of the various rollers 31, 32, and 34 are rotatably mounted on the frame 30, and the opposite ends of the rollers are mounted in a similar frame 30 which is not shown for the sake of convenience. The support unit 140 is movably installed on the base board 110 to be capable of selectively contacting the inner surface of the photoreceptor belt 40. The moving means moves the support unit 140 toward and separates it from the base board 110.

The support unit 140 includes a pair of first support units 120 installed to be operative to approach each other and to separate from each other by moving in an up and down direction with the base board 110 located therebetween, and a pair of second support units 130 capable of approaching each other and separating from each other from side to side, and having the base board 110 located therebetween.

Each of the first support units 120 is supported by a first bracket 124 movably installed on the base board 110, and has a plurality of first support bars 122 which selectively contact the inner surface of the photoreceptor belt 40. The first support bars 122 are spaced a predetermined distance apart from each other to avoid interference with the support rollers 31, 32 and 33 and the backup rollers 34. It is preferable that the first support bars 122 each have a plate spring structure which is round toward the inner surface of the photoreceptor belt 40 to prevent warping due to the load of the photoreceptor belt 40. The first bracket 124 is warped longitudinally in consideration of the arrangement positions of the first support bars 122. A plurality of guide members 126 slidably coupled to first guide portions 112 installed on the base board 110 are installed on the first bracket 124.

Each of the second support units 130 is supported at one end by a corresponding second bracket 134 slidably installed on the base board 110, and has a plurality of second support bars 132 that selectively contact the inner surface of the photoreceptor belt 40. The second support bars 132 are spaced a predetermined distance apart from each other to avoid interference with the support rollers 31 and 33. It is preferable that the second support bars 132 each have a plate spring structure which is round toward the inner surface of the photoreceptor belt 40 to prevent warping due to the load of the photoreceptor belt 40, similar to the first support bars 122.

One end of the second bracket 134 is slidably coupled to a second guide portion 114 installed on the base board 110, and the other end thereof is branched at a predetermined position to support the second support bars 132 spaced a predetermined distance from each other.

The moving means includes a cam 142 rotatably installed on the base board 110 to be operative to contact the first brackets 124, connection members 144 each hinged at one end on a corresponding one of the second brackets 134 of each of the second support units 130 and hinged at the other end on the cam 142, and elastic members 146 for elastically biasing the first brackets 124 toward the cam 142. The cam 142 is installed so that its outer circumferential surface comes into contact with the substantial centers of the first brackets 124, and a cam shaft 141 is rotatably coupled to the base board 110 and the frame 30. It is preferable that the elastic members 146 are tensile springs each connected to a corresponding one of the first brackets 124 and the base board 110.

Figure 3:
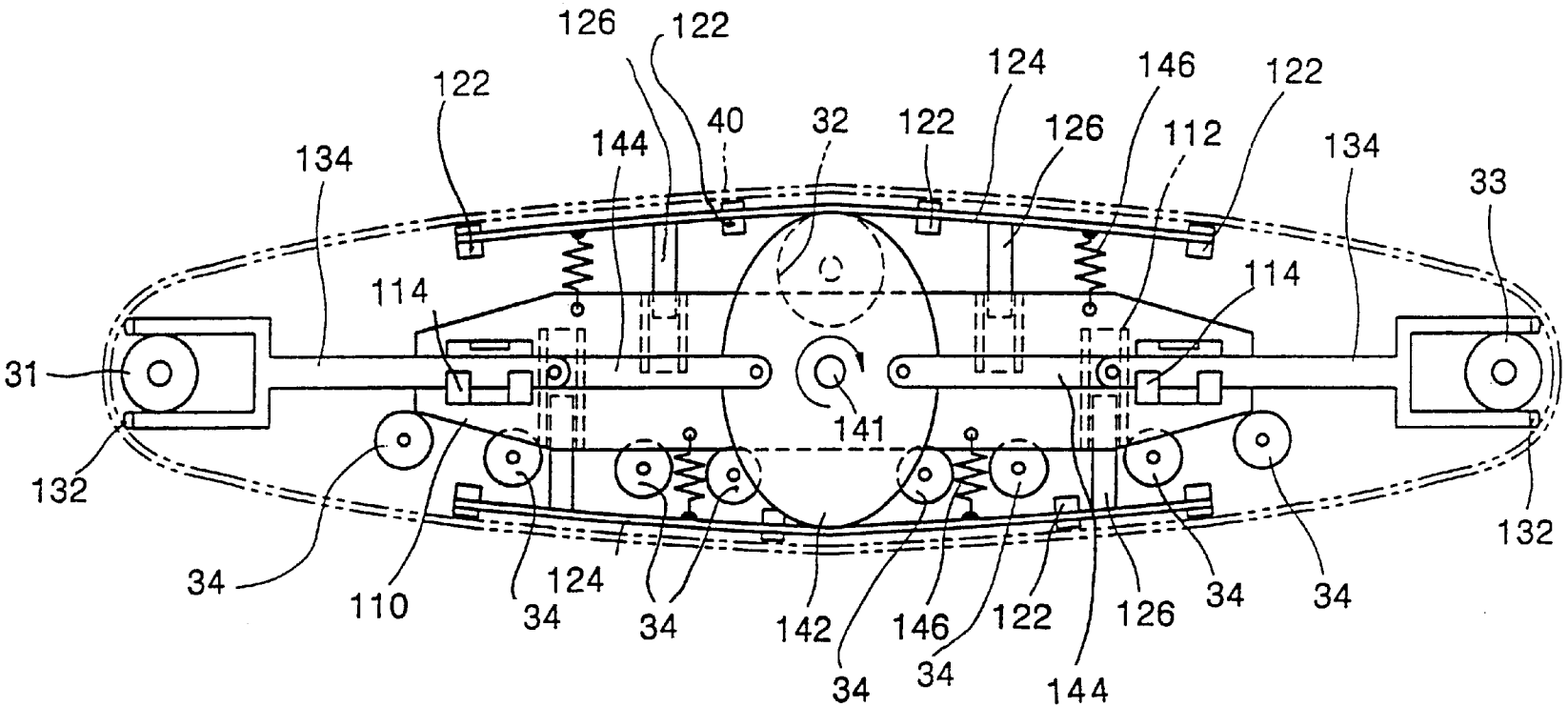
FIGS. 3 and 4 are schematic front views illustrating the operation of the belt cartridge of FIG. 2.

In the operation of the belt cartridge for a printing apparatus according to the preferred embodiment of the present invention having such a configuration, as shown in FIG. 3, the belt cartridge supporting the photoreceptor belt 40 is inserted into the belt unit in a state where the plurality of first support bars 122 and second support bars 132 are separated a maximum distance from the cam 142, since the large diameter portion of the cam 142 contacts the first brackets 124. Then, the photoreceptor belt 40 is located to be capable of covering the outer surfaces of the plurality of support rollers 31, 32, 33 and backup rollers 34. Here, the support roller 33 is in a state of approaching the cam 142.

Next, one end of the cam shaft 141 is coupled to the frame 30 to fix the position of the belt cartridge with respect to the frame 30 and the belt unit.

Figure 4:
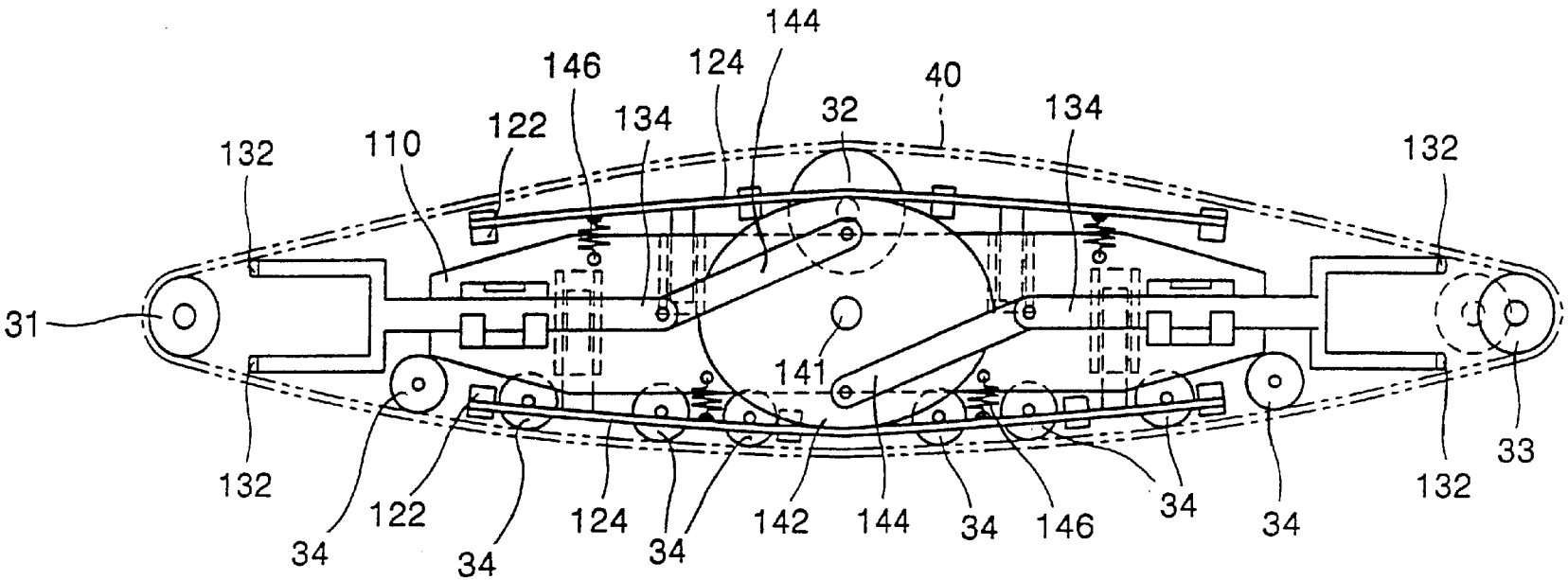

Thereafter, as shown in FIG. 4, when the cam 142 is rotated about 90° by a predetermined driving source (not shown), the first brackets 124 biased by the elastic members 146 are moved toward the cam 142, and the second brackets 134 are moved toward the cam 142 by the connection members 144 which interlock with the cam 142. That is, the interval between the first and second brackets 124 and 134 is at a minimum. In this way, the first and second support bars 122 and 132 are detached from the photoreceptor belt 40, and simultaneously, the photoreceptor belt 40 comes into contact with the support rollers 31, 32 and 33 and the backup rollers 34 and is supported by them. At this time, when the support roller 33 is moved away from the cam 142 starting from a position indicated by a dotted line, tension with which normal printing can be performed is applied to the photoreceptor belt 40.

Meanwhile, the belt cartridge mounted on the belt unit does not interfere with the movement of the support rollers 31, 32 and 33 and the backup rollers 34, so that it can be continuously mounted on the belt unit. In order to replace a contaminated photoreceptor belt 40 or repair the belt cartridge, the support roller 33 is moved to the position indicated by the dotted line, and the cam 142 is rotated 90°, so that the first and second brackets 124 and 134 of the belt cartridge are separated a maximum distance from the cam 142 as shown in FIG. 3. Then, the photoreceptor belt 40 is separated from the support rollers 31, 32 and 33 and again contacts the first and second support bars 122 and 132 and is supported by them. At this time, the belt cartridge is separated from the belt unit, so that the photoreceptor belt 40 is also removed.

In the belt cartridge according to the present invention as described above, the support bars installed on the first and second brackets interlocking with the cam selectively contact the photoreceptor belt, such that printing is performed in the printing apparatus in which the belt cartridge is continuously installed without being separated from the belt unit even after the photoreceptor belt 40 is mounted on the belt unit. Therefore, the photoreceptor belt can be easily replaced, and mismounting of the photoreceptor belt can be prevented by excluding the conventional manual belt replacing operation.

It is contemplated that numerous modifications may be made to the belt cartridge of the present invention without departing from the spirit and scope of the invention as defined in the following claims.

What is claimed is:

1. A belt cartridge in a printing apparatus in which a photoreceptor belt to be mounted on a belt unit is received, said belt cartridge comprising:

a base board attachable to or detachable from the belt unit to be operative to face the belt unit at one surface;

a support unit movably installed on the base board and operative to selectively contact an inner surface of the photoreceptor belt; and means for moving the support unit toward the base board and for isolating the support unit from the base board.

2. The belt cartridge of claim 1, wherein the support unit comprises:

a pair of first support units selectively contacting the inner surface of the photoreceptor belt while approaching each other or being separated from each other in an up and down direction with the base board located therebetween; and a pair of second support units selectively contacting the inner surface of the photoreceptor belt while approaching each other or being separated from each other from side to side and having the base board located therebetween.

3. The belt cartridge of claim 2, wherein each of the first support units comprises:

a plurality of first support bars which selectively contact the inner surface of the photoreceptor belt and are spaced a predetermined distance apart from each other to avoid interference with the belt unit; and first brackets which support one end of each of the first support bars and are movably installed on the base board.

4. The belt cartridge of claim 2, wherein each of the second support units comprises:

a plurality of second support bars which selectively contact the inner surface of the photoreceptor belt and are spaced a predetermined distance apart from each other to avoid interference with the belt unit; and second brackets which support one end of each of the second support bars and are slidably installed on the base board.

5. The belt cartridge of claim 2, wherein the moving means comprises:

a cam rotatably installed on the base board and operative to contact the pair of first support units;

connection members each hinged at one end to a corresponding one of the second support units and hinged at an other end to the cam; and elastic members for elastically biasing the pair of first support units toward the cam.

6. A belt cartridge in a printing apparatus in which a photoreceptor belt to be mounted on a belt unit is received, said belt cartridge comprising:

a base board attachable to or detachable from the belt unit to be operative to face the belt unit at one surface;

a support unit movably installed on the base board and operative to selectively contact an inner surface of the photoreceptor belt; and a mechanism which moves the support unit toward the base board and which separates the support unit from the base board.

7. A belt cartridge in a printing apparatus in which a photoreceptor belt to be mounted on a belt unit is received, said belt cartridge comprising:

a base board attachable to or detachable from the belt unit to be operative to face the belt unit at one surface;

a support unit movably installed on the base board and operative to selectively contact an inner surface of the photoreceptor belt;

a cam rotatably installed on the base board and operative to contact the support unit; and elastic members for elastically biasing the support unit toward the cam, thereby to move the support unit toward the base board and to separate the support unit from the base board, depending on a rotational position of the cam.

* * * * *